US006433762B1

(12) United States Patent
Huang

(10) Patent No.: US 6,433,762 B1
(45) Date of Patent: Aug. 13, 2002

(54) METHOD AND APPARATUS FOR DRIVING A PLASMA DISPLAY PANEL

(75) Inventor: Jih Fon Huang, Chu-Bei (TW)

(73) Assignee: Acer Display Technology, Inc., Hsinchu (TW)

( * ) Notice: Subject to any disclaimer, the term of this patent is extended or adjusted under 35 U.S.C. 154(b) by 0 days.

(21) Appl. No.: 09/432,550

(22) Filed: Nov. 3, 1999

(30) Foreign Application Priority Data

Nov. 5, 1998 (TW) ..... 08711452

(51) Int. Cl.[7] ..... G09G 3/28
(52) U.S. Cl. ..... 345/60
(58) Field of Search ..... 345/55, 89, 67, 345/68, 69, 88, 60, 63, 103, 148, 100; 348/671

(56) References Cited

U.S. PATENT DOCUMENTS 5,420,602 A 5/1995 Kanazawa
5,717,437 A * 2/1998 Sano et al. ..... 345/211
5,898,414 A * 4/1999 Awamoto et al. ..... 345/55
6,084,558 A * 7/2000 Setoguchi et al. ..... 345/60
6,160,529 A * 12/2000 Asao et al. ..... 345/60
6,252,574 B1 * 6/2001 Hosoi et al. ..... 345/103

* cited by examiner

*Primary Examiner*—Richard Hjerpe
*Assistant Examiner*—Ronald Laneau
(74) *Attorney, Agent, or Firm*—Ladas & Parry

(57) ABSTRACT

A method for driving a plasma display panel comprises the steps of reset, scanning and sustaining discharge. The plasma display panel has display lines comprising SCANNING and SUSTAINING electrodes disposed in parallel with each other, and addressing electrodes extending orthogonally to the SCANNING and SUSTAINING electrodes. The method is characterized in that the step of sustaining discharge is carried out by alternately applying a first driving pulse to the two SCANNING electrodes of each pair of the neighboring display lines and a second driving pulse to the two SUSTAINING electrodes of each pair of the neighboring display lines so that each two of the neighboring electrodes of two respective display lines are identical in polarity during the sustaining discharge.

7 Claims, 9 Drawing Sheets

METHOD AND APPARATUS FOR DRIVING A PLASMA DISPLAY PANEL

BACKGROUND OF THE INVENTION

1. Field of the Invention

The present invention is related to a plasma display panel, and particularly to a method and apparatus for driving a plasma display panel, which reduces dark areas on the display panel by a new arrangement of the polarities of the scanning and sustaining electrodes during the sustaining discharge.

2. Description of the Related Art

A conventional plasma display panel 10 is schematically shown in FIG. 1. The plasma display panel 10 comprises display lines L1~L600 and addressing electrodes A1~A400. The display lines L1~L600 comprise pairs of scanning and sustaining electrodes (X1, Y1)~(X600, Y600) respectively. The scanning and sustaining electrodes (X1, Y1)~(X600, Y600) are disposed in parallel with each other and orthogonal to the addressing electrodes A1~A400. Areas 11 between the scanning and sustaining electrodes (X1, Y1)~(X600, Y600) are luminous areas where sustaining discharge is carried out. On the other hand, areas 12 between two neighboring display lines (i.e., areas between the two neighboring electrodes of two respective display lines) are dark areas where no sustaining discharge is carried out.

FIG. 2 is a timing diagram showing a subframe of a conventional method for driving the plasma display panel 10 shown in FIG. 1. In practice, it takes several subframes, 8 for example, to show a complete image for one frame. In FIG. 2, each subframe comprises periods of reset, scanning and sustaining discharge. All the display lines of the plasma display panel 10 are reset during the reset period and display data is written to all display cells (not shown) of the display plasma panel 10 by the addressing electrodes A1~A400 during the scan period. The sustain discharge period will be explained in detail. During the sustain discharge period, a driving pulse 21 is applied to the scanning electrodes X1~X600 and alternately, a driving pulse 22 is applied to the sustaining electrodes Y1~Y600. Thus, the discharge therebetween is maintained for sustained emission of light. More specifically, in the plasma display panel 10, all the scanning electrodes X1~X600 have the same applied voltage and the same polarity because they are connected together. Correspondingly, by the applied driving pulses 22, the polarities of all the sustaining electrodes Y1~Y600 are also the same but opposite to those of the scanning electrodes X1~X600 during the sustaining discharge. This results in wall charges accumulated in a MgO film over the scanning electrodes X1~X600 and the sustaining electrodes Y1~Y600 of the display lines L1~L600.

FIG. 3 schematically shows the polarities of the scanning and sustaining electrodes and the induced wall charges during the sustain discharge period within a subframe applying the conventional method. It is noted that the polarities of the sustaining electrode $Y_{N-1}$ and $Y_N$ of the display line $L_{N-1}$ and $L_N$ are positive, which are opposite to those of the scanning electrode $X_N$ and $X_{N+1}$ of the neighboring display line $L_N$ and $L_{N+1}$, which are negative. Namely, each two of the neighboring electrodes of two respective display lines are opposite in polarity during the sustaining discharge. Therefore, the polarities of the wall charges accumulated in a MgO film 30 over the scanning electrodes X1~X600 and the sustaining electrodes Y1~Y600 are in, for example, the order of −, +, −, +, −, . . . , − or in the order of +, −, +, −, . . . , +, −. This may results unexpected discharge in the dark area 12 between each two of the neighboring display lines when the distance therebetween is short enough. Consequently, in the conventional method, there is a need for a sufficiently large dark area that disadvantageously reduces the luminance of images shown by the display plasma panel.

To eliminate the above problem, a method for driving a plasma display panel is provided in U.S. Pat. No. 5,420,602, which reduces the dark area and also avoids the unexpected discharge.

FIG. 4 schematically shows the polarities of the scanning and sustaining electrodes and the induced wall charges during the sustaining discharge within a subframe applying the method provided in U.S. Pat. No. 5,420,602. It is noted that the disposition of the scanning and sustaining electrodes is different from that of FIG. 3. In FIG. 4, the scanning and sustaining electrodes are disposed in the order of ($X_{N-1}$, $Y_{N-1}$), ($Y_N$, $X_N$), ($X_{N-1}$, $Y_{N+1}$) Namely, each two of the neighboring electrodes of two respective display lines are identical in polarity during the sustaining discharge. Such disposition results in a new arrangement of the polarities of the induced wall charges in the MgO film 30 over the scanning and sustaining electrodes. The polarities of the induced wall charges are in the order of +, −, −, +, +, −. Therefore, the unexpected discharge no longer occurs even in a small dark area.

However, in the method provided in U.S. Pat. No. 5,420,602, there is a need for reconstruction of the plasma display panel for the above-mentioned disposition of the scanning and sustaining electrodes, which disadvantageously increases the complexity of the peripheral circuit.

SUMMARY OF THE INVENTION

A method and apparatus for driving a plasma display panel are provided in the present invention, which reduces the dark area and avoids the unexpected discharge without the need for reconstruction of the plasma display panel.

One of the objects of the invention is to provide a method for driving a plasma display panel comprising the steps of reset, scanning and sustaining discharge. The plasma display panel has display lines comprising scanning electrodes and sustaining electrodes disposed in parallel with each other, and addressing electrodes extending orthogonally to the scanning and sustaining electrodes. The method is characterized in that the step of sustaining discharge is carried out by alternately applying a first driving pulse to the two scanning electrodes of each pair of the neighboring display lines and a second driving pulse to the two sustaining electrodes of each pair of the neighboring display lines so that each two of the neighboring electrodes of two respective display lines are identical in polarity during the sustaining discharge.

Another one of the objects of the invention is to provide an apparatus for driving a plasma display panel. The plasma display panel has odd-numbered and even-numbered display lines both comprising scanning electrodes and sustaining electrodes disposed in parallel with each other, and a plurality of addressing electrodes extending orthogonally to the scanning and sustaining electrodes. The apparatus comprises a first, second, third and fourth driver. The first driver alternately applies a high and low voltage level to the sustaining electrodes of the odd-numbered display lines. The second driver alternately applies the high and low voltage level to the sustaining electrodes of the even-numbered display lines. The third driver alternately applies the high and low voltage level to the scanning electrodes of the odd-numbered display lines. The fourth driver alternately applies the high and low voltage level to the scanning electrodes of the even-numbered display lines. Thereby, during the sustaining discharge of the plasma display panel, the high voltage level is applied to the scanning electrodes of the odd-numbered display lines and the sustaining electrodes of the even-numbered display lines when the low voltage level is applied to the sustaining electrodes of the odd-numbered display lines and the scanning electrodes of the even-numbered display lines, and the low voltage level is applied to the scanning electrodes of the odd-numbered display lines and the sustaining electrodes of the even-numbered display lines when the high voltage level is applied to the sustaining electrodes of the odd-numbered display lines and the scanning electrodes of the even-numbered display lines.

Accordingly, during the sustain discharge period, each two of the neighboring electrodes of two respective display lines are identical in polarity, which results from the timing of the applied driving pulses instead of disposition of the scanning and sustaining electrodes. Therefore, there is no need for reconstruction of the plasma display panel in the invention.

DESCRIPTION OF THE PREFERRED EMBODIMENT

Figure 1:
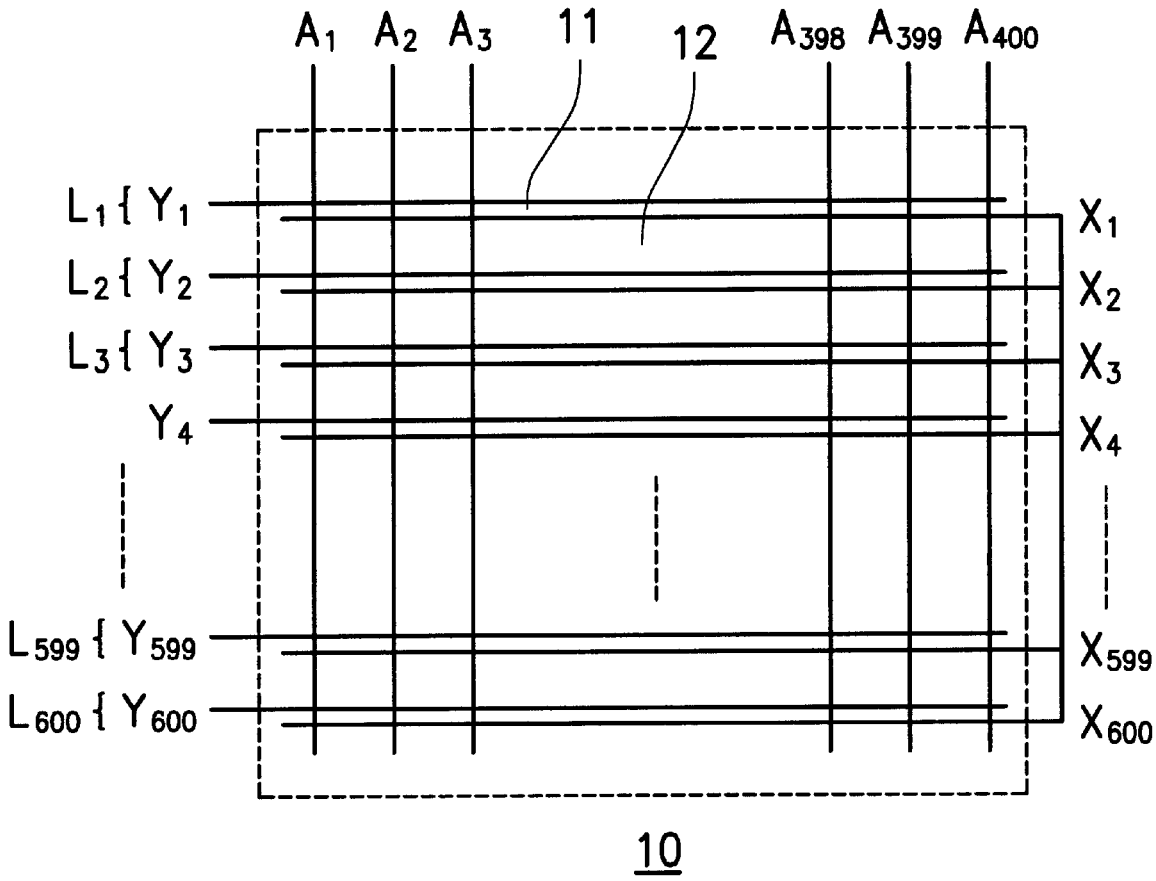
FIG. 1 (PRIOR ART)
FIG. 1 is a diagram showing a conventional plasma display panel.
Figure 5:
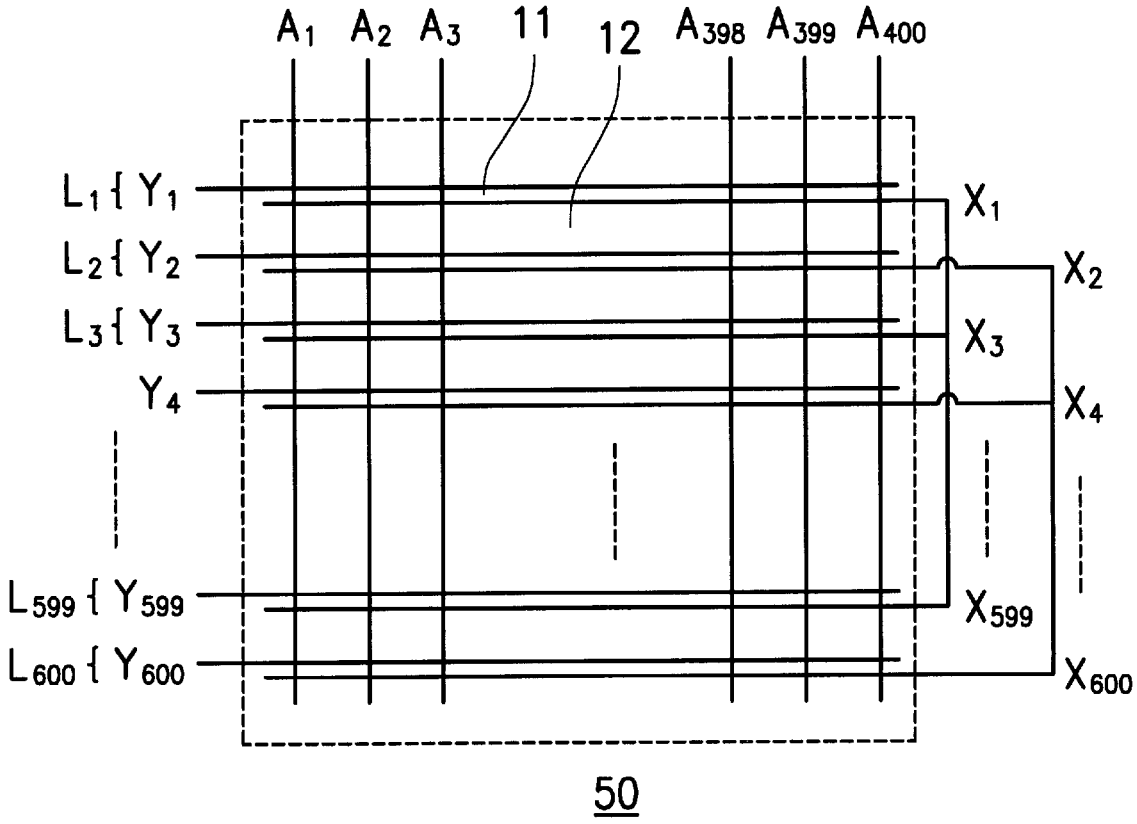
FIG. 5 is a diagram showing a plasma display panel according to the present invention.

FIG. 5 is a schematic diagram showing a plasma display panel 50 according to the present invention. In FIG. 5, the elements identical to those of FIG. 1 use the same symbol for clarity. The plasma display panel 50 comprises display lines L1~L600 and addressing electrodes A1~A400. Each of the display lines L1~L600 is defined by one scanning electrode and one sustaining electrode. There are 600 scanning electrodes X1~X600, and 600 sustaining electrodes Y1~Y600. These scanning electrodes and these sustaining electrodes are interleaved disposed. These scanning electrodes are sequentially numbered as odd-numbered scanning electrodes and even-numbered scanning electrodes. These sustaining electrodes are also sequentially numbered as odd-numbered sustaining electrodes and even-numbered sustaining electrodes. For example, the first display line L1 is defined by the pair of odd-numbered scanning and odd-numbered sustaining electrodes (X1, Y1); and the second display line L2 is defined by the pair of even-numbered scanning and even-numbered sustaining electrodes (X2, Y2). The scanning and sustaining electrodes (X1, Y1)~(X600, Y600) corresponding to the displaying lines (L1~L600) are disposed in parallel with each other and orthogonal to the addressing electrodes A1~A400. The area 11 between the scanning electrode X1 and the sustaining electrode Y1 is the corresponding luminous area of the display line L1 where sustaining discharge is carried out. On the other hand, the area 12 between the X1 electrode of the display line L1 and the Y2 electrode of the display line L2 (i.e., area between two neighboring display lines) is dark area where no sustaining discharge should be carried out. It is noted that the odd-numbered scanning electrodes (X1, X2, X3, . . . X599) of the odd display lines L1, L3, . . . , L599 are connected together and the even-numbered scanning electrodes (X2, X4, X6 . . . X600) of the even display lines L2, L4, . . . , L600 are also connected together. Thus, the scanning electrodes are separated into two groups which can be driven by two different signals of opposite polarities during the sustain discharge period, which is a main distinction between the plasma display panels of FIG. 1 and FIG. 5.

Figure 6:
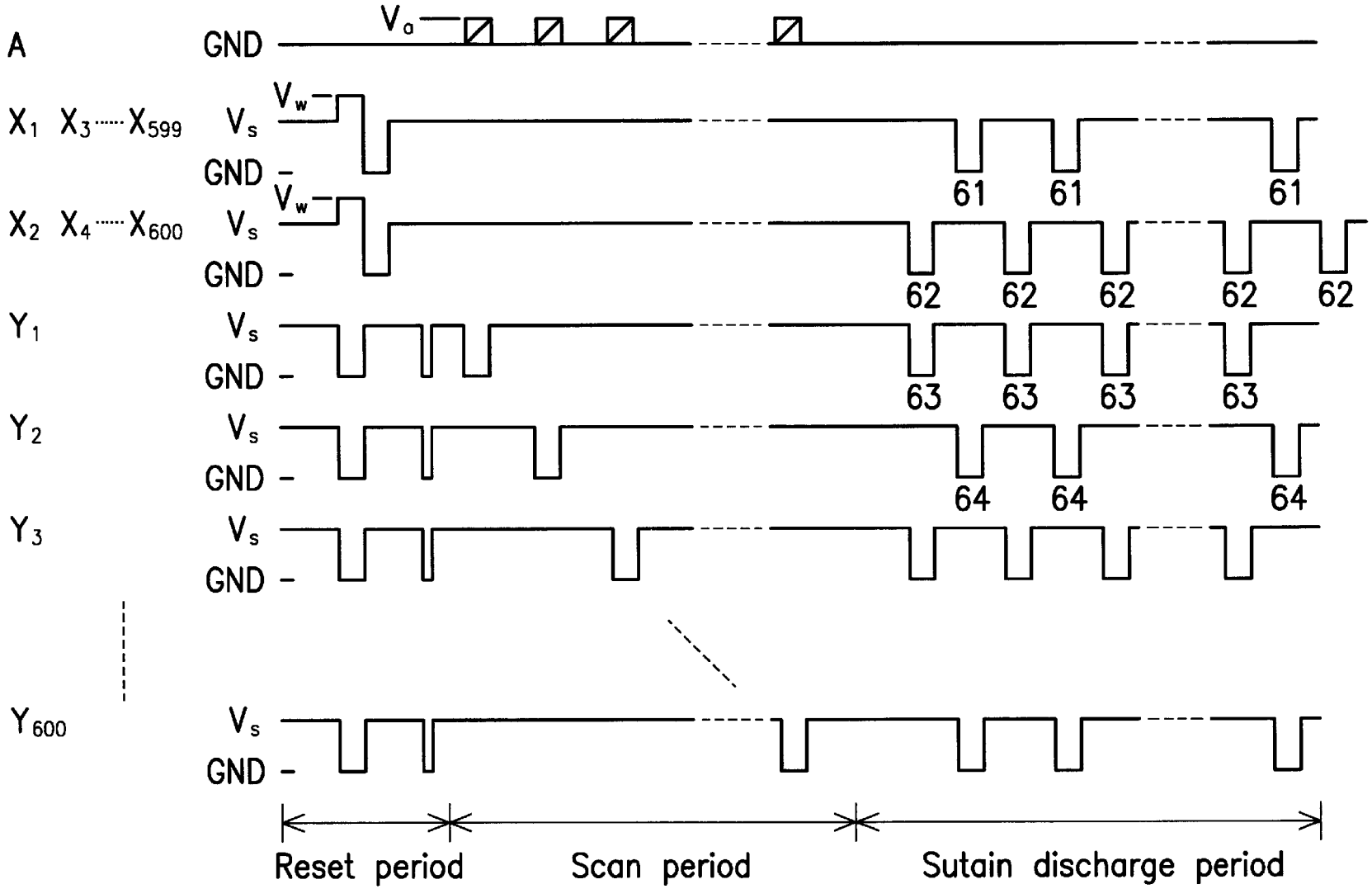
FIG. 6 is a timing diagram of a subframe of the plasma display panel showing a subframe applying the method provided in the present invention.

FIG. 6 is a timing diagram showing a subframe with negative driving pulses according to the present invention. In FIG. 6, each subframe comprises one reset period, one scan period, and one sustain discharge period. During the reset period, all the display lines of the plasma display panel 50 are reset. During the scan period, the display data is sequentially written to all display cells (not shown) of the display plasma panel 50 by the addressing electrodes A1~A400. During the sustain discharge period, driving pulses 61~64 are applied to the scanning and sustaining electrodes (X1, Y1)~(X600, Y600), whereby the discharge therebetween is maintained for sustained emission of light.

Figure 2:
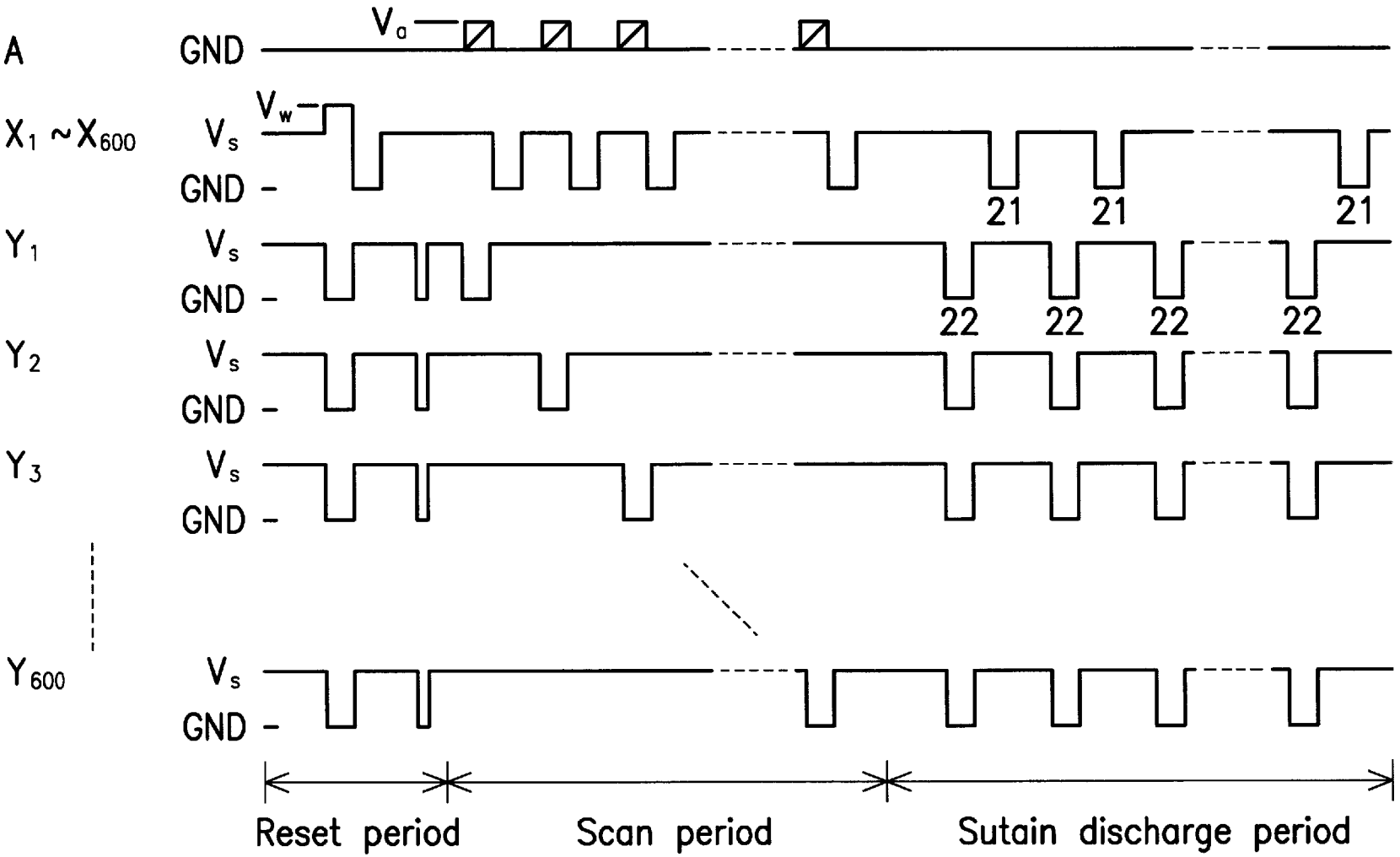
FIG. 2 is a timing diagram showing a subframe applying a conventional method for driving the plasma display panel of FIG. 1.

Different from the prior art shown in FIG. 2, during the sustain discharge period, the odd display lines and even display lines of present invention are simultaneously applied with different driving pulses to make (1) the odd-numbered scanning electrodes of the odd display lines and even-numbered sustaining electrodes of the even display lines maintained in the first polarity, (2) the odd-numbered sustaining electrodes of the odd display lines and the even-numbered scanning electrodes of the even display lines maintained in the second polarity. That is, the polarities of these odd-numbered scanning electrodes and even-numbered sustaining electrodes are identical, and the polarities of these even-numbered scanning electrodes and odd-numbered sustaining electrodes are identical.

In other words, (1) when a low voltage level (driving pulses 61, pulses 64) is applied onto these odd-numbered scanning electrodes and even-numbered sustaining electrodes, a high voltage level is simultaneously maintained on these even-numbered scanning electrodes and odd-numbered sustaining electrodes, and (2) when a low voltage level (driving pulse 62, pulse 63) is applied onto these even-numbered scanning electrodes and odd-numbered sustaining electrodes, a high voltage level is simultaneously maintained on these odd-numbered scanning electrodes and even-numbered sustaining electrodes.

As shown in FIG. 6, when the driving pulse 62 is applied to (X2, X4, . . . X600) and driving pulse 63 is applied to (Y1, Y3 . . . Y599), the scanning electrodes of odd display lines and sustaining electrodes of even display lines are all maintained in positive polarity, and the scanning electrodes of even display lines and sustaining electrodes of odd display lines are all maintained in negative polarity.

Similarly, when the driving pulse 61 is applied to (X1, X3, . . . X599) and driving pulse 64 is applied to (Y2, Y4 . . . Y600), the scanning electrodes of odd display lines and sustaining electrodes of even display lines are all maintained in negative polarity, and the scanning electrodes of even display lines and sustaining electrodes of odd display lines are all maintained in positive polarity.

By sequentially and alternatively applying the driving pulses 61~64 to the scanning and sustaining electrodes, the voltage drop maintained between each pair of the scanning and sustaining electrodes of two neighboring display lines are opposite in polarity. When the driving pulses 62 and 63 are applied, the polarities of the scanning and sustaining electrodes of the odd display lines L1, L3, . . . , L599 are positive and negative respectively, and those of the scanning and sustaining electrodes of the even display lines L2, L4 . . . , L600 are negative and positive, respectively. Alternately, when the driving pulses 61 and 64 are applied, the polarities of the scanning and sustaining electrodes of the odd display lines L1, L3, . . . , L599 are negative and positive respectively, and those of the scanning and sustaining electrodes of the even display lines L2, L4 . . . , L600 are positive and negative, respectively.

Figure 3:
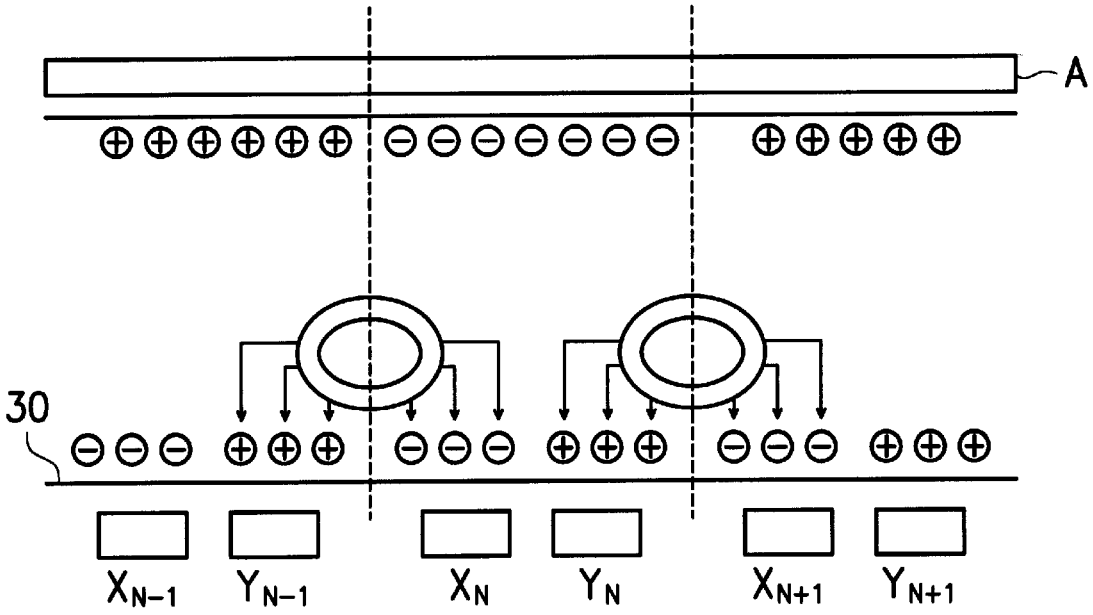
FIG. 3 schematically shows the polarities of the scanning and sustaining electrodes and the induced wall charges during the sustain discharge period within a subframe of the conventional method.
Figure 4:
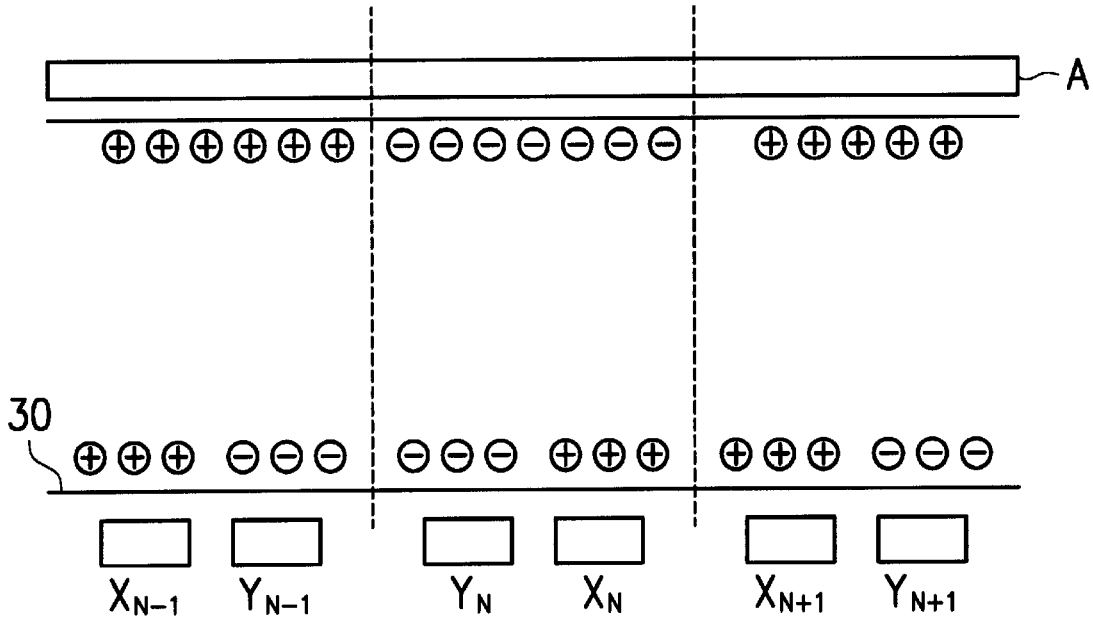
FIG. 4 schematically shows the polarities of the scanning and sustaining electrodes and the induced wall charges during the sustain discharge period within a subframe of the method provided in U.S. Pat. No. 5,420,602.
Figure 7:
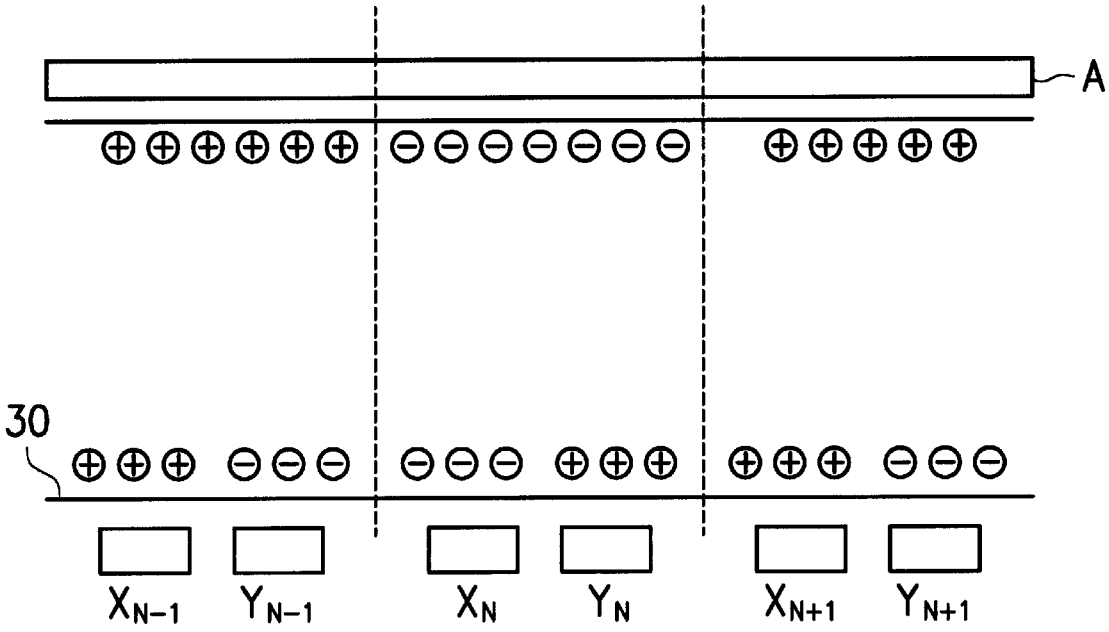
FIG. 7 schematically shows the polarities of the scanning and sustaining electrodes and the induced wall charges during the sustain discharge period within a subframe applying the method provided in the present invention.

FIG. 7 schematically shows the polarities of the scanning and sustaining electrodes and the induced wall charges during the sustain discharge period according to the present invention. In FIG. 7, the elements identical to those of FIG. 3 use the same symbol for clarity. It is noted that (1) the polarity of the sustaining electrode $Y_{N-1}$ and the scanning electrode $X_N$ are identical; and (2) the polarity of the sustaining electrode $Y_N$ and the scanning electrode $X_{N+1}$ are identical. Namely, each two of the neighboring electrodes of two neighboring display lines are identical in polarity during the sustain discharge period. Therefore, the polarities of the wall charges accumulated in the MgO film 30 over the scanning electrodes and the sustaining electrodes X1, Y1, X2, Y2, X3, Y3 are in, for example, the order of +, −, −, +, +, − or in the order of −, +, +, −, −, +. The unexpected discharge between two neighboring display lines will no longer occur even in a small dark area. Consequently, there is no need to maintain a sufficiently large dark area so that luminance of the images shown by the display plasma panel can be increased.

Figure 8:
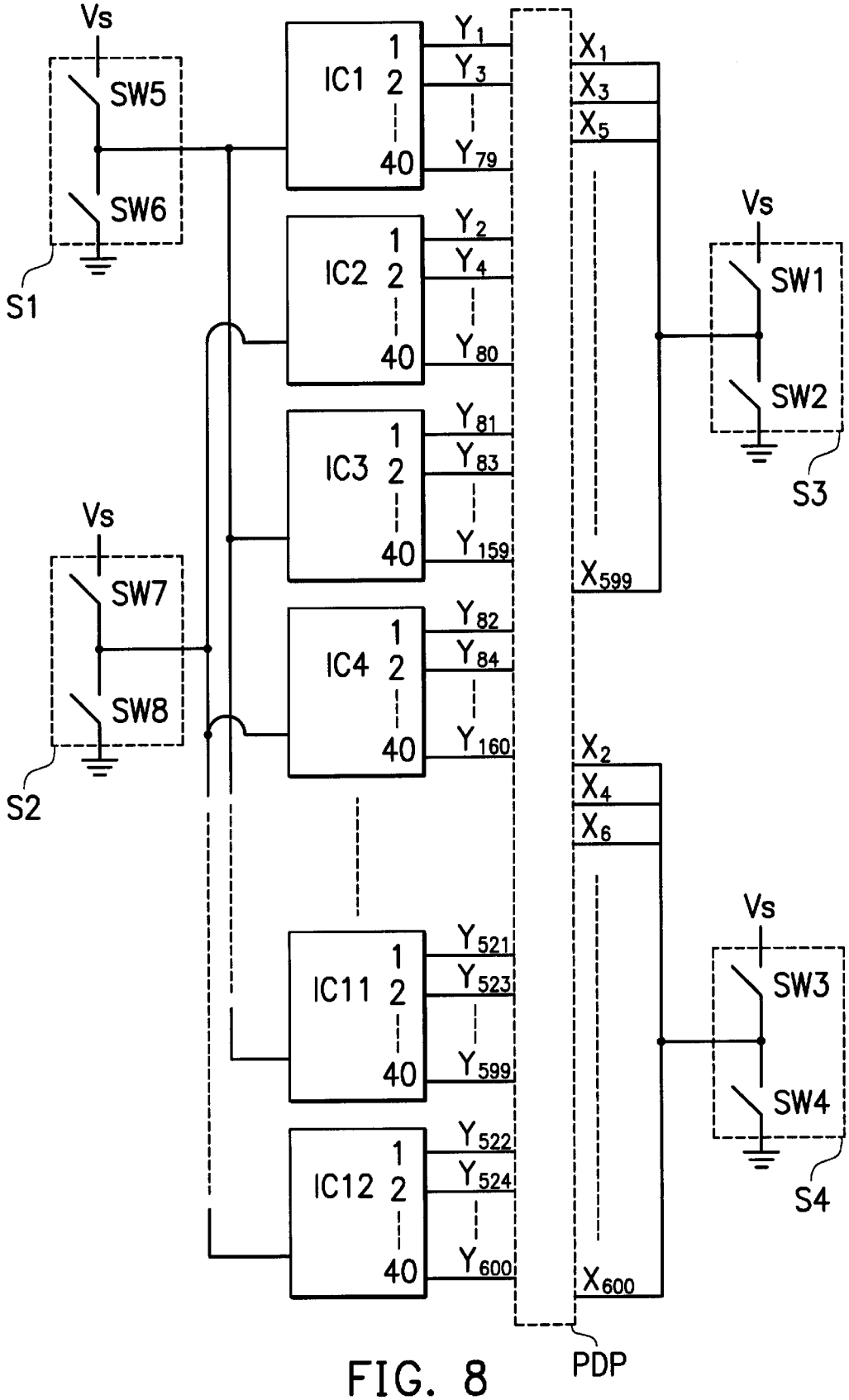
FIG. 8 is a block diagram of the apparatus for driving the plasma display panel of FIG. 5.

FIG. 8 is a block diagram of the apparatus for driving the plasma display panel of FIG. 5. The sustaining electrodes Y1, Y3, . . . , Y599 are connected to corresponding driver circuits IC1, IC3, . . . , IC11, by which the driving pulses 63 is applied to the sustaining electrodes Y1, Y3, . . . , Y599 of odd display lines L1, L3, . . . , L599. Similarly, the sustaining electrodes Y2, Y4, . . . , Y600 are connected to corresponding driver circuits IC2, IC4, . . . , IC12, by which the driving pulses 64 is applied to the sustaining electrodes Y2, Y4, . . . , Y600 of even display lines L2, L4, . . . , L600. The driver circuits IC1, IC3, . . . , IC599 are connected to a switch S1 switching between Vs and GND while the driver circuits IC2, IC4, . . . , IC600 are connected to a switch S2 switching between Vs and GND. Moreover, the scanning electrodes X1, X3, . . . , X599 of the odd display lines L1, L3, . . . , L599 and the scanning electrodes X2, X4, . . . , X600 of the even display lines L2, L4, . . . , L600 are respectively connected to switches S3 and S4 both switching between Vs and GND, whereby the driving pulses 61 and 62 are applied.

The switches S1, S2, S3 and S4 each comprise two sub-switches connected in series and switch in response to the control signal (SW5, SW6), (SW7, SW8), (SW1, SW2) and (SW3, SW4) respectively. In response to the control signals SW1~SWB, the driving pulses 61~64 are selectively produced by the switches S1~S4 and the driver circuits IC1~IC12 controlled by the switches S1, S2, and the polarities of the scanning and sustaining electrodes are controlled during the sustain discharge period. In FIG. 6, the high and low voltage applied by the switches S1, S2, S3 and S4 are all the same as Vs and GND respectively. However, to maintain the right polarities of the scanning electrodes and sustaining electrodes, the switches S1, S2, S3 and S4 can also selectively apply the high voltages in different positive voltage levels, or the low voltages in different negative voltage levels.

Figure 9A:
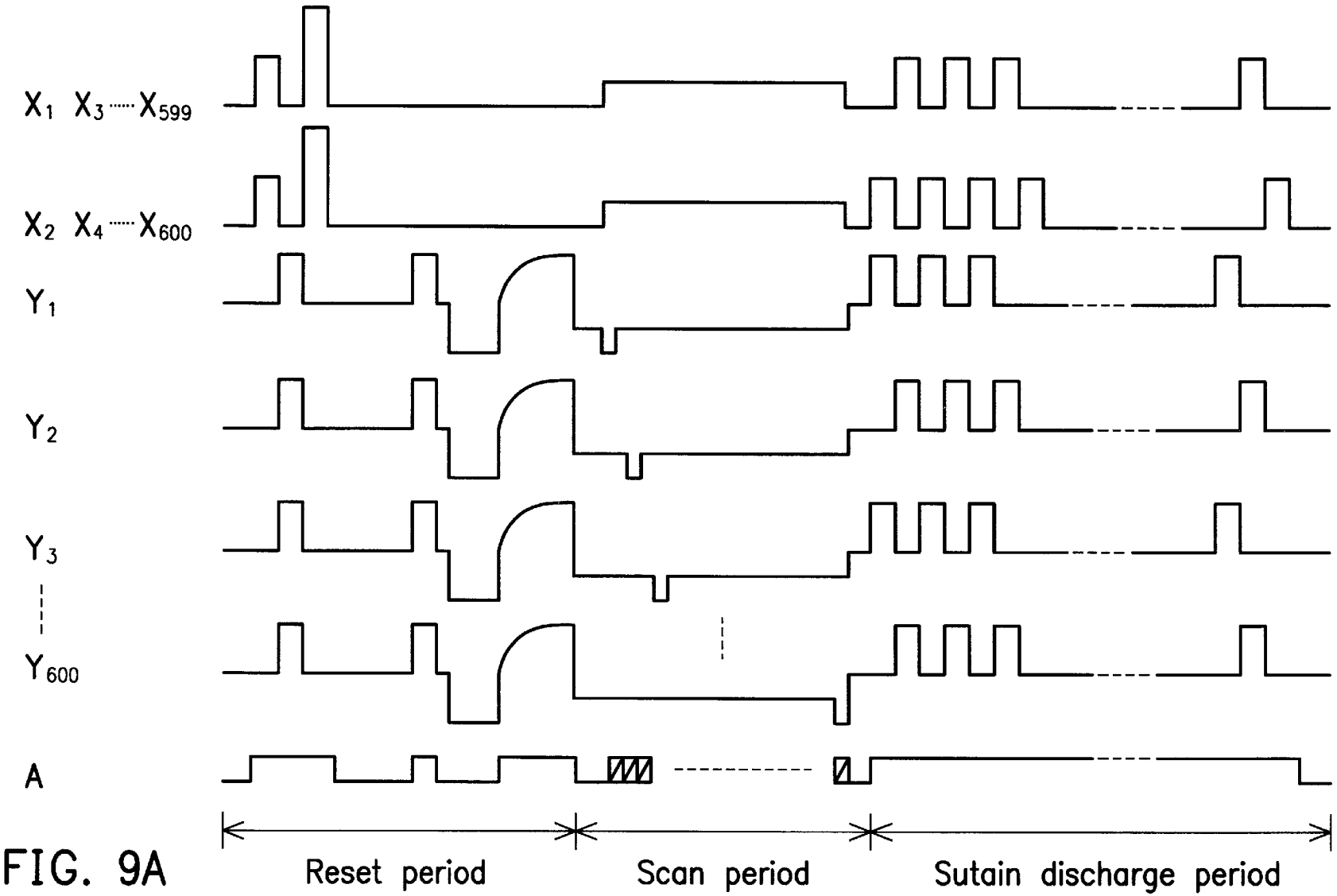
FIG. 9A is a timing diagram showing driving signals of the plasma display panel for the scanning and sustaining electrodes which showed in FIG. 8.
Figure 9B:
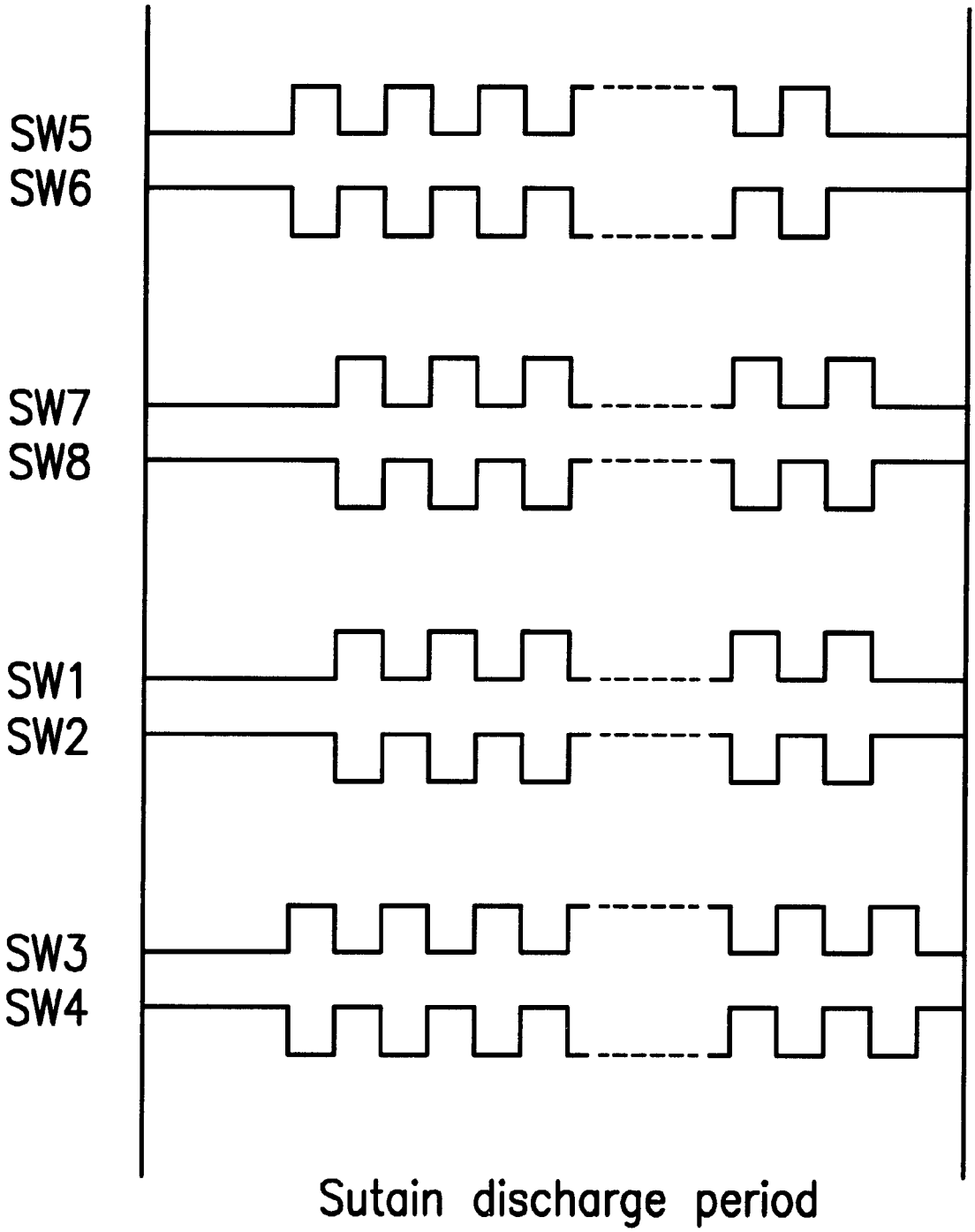
FIG. 9B is a timing diagram showing the control signals of SW1~SW8 which showed in FIG. 8.

FIGS. 9A and 9B are timing diagrams showing positive driving pulses for the scanning and sustaining electrodes of the plasma display panel, and the control signals SW1~SW8 in FIG. 8. The sustaining discharge is carried out by the odd and even display lines alternately.

Referring to FIG. 9A, during the sustain discharge period, (1) when in the first mode, a low voltage is applied to all even-numbered sustaining electrodes and odd-numbered scanning electrodes; and a high voltage is applied to all even-numbered scanning electrodes and all odd-numbered sustaining electrodes. (2) alternately in the second mode, the high voltage is applied to all even-numbered sustaining electrodes and all odd-numbered scanning electrodes; and the low voltage is applied to all odd-numbered sustaining electrodes and all even-numbered scanning electrodes.

Referring to FIG. 9B, when in the first mode, the control signals SW2, SW3, SW5 and SW8 are at a high voltage level, and SW1, SW4, SW6 and SW7 are at a low voltage level. Alternately, when in the second mode, the control signals SW2, SW3, SW5 and SW8 are at the low voltage level, and SW1, SW4, SW6 and SW7 are at the high voltage level.

In conclusion, the present invention provides a method and apparatus for driving a plasma display panel, wherein each two neighboring electrodes of two respective display lines of the plasma display panel are identical in polarity during the sustain discharge period because of the timing of the applied driving pulses. Thus eliminates the need for a sufficiently large dark area so that the luminance of images shown by the plasma display panel may increase.

The embodiment described above is illustrative of the principles of the present invention and is not intended to limit the invention to the particular embodiment described. Those skilled in the art may make various changes in the embodiments without departing from the spirit and scope of the invention. Various embodiments are within the scope of the following claims.

What is claimed is:

1. A method for driving a plasma display panel which comprising a plurality of scanning electrodes and a plurality of sustaining electrodes, said scanning electrodes and said sustaining electrodes being interleaved disposed, said scanning electrodes sequentially numbered as odd-numbered scanning electrodes and even-numbered scanning electrodes, said sustaining electrodes sequentially numbered as odd-numbered sustaining electrodes and even-numbered sustaining electrodes, wherein the improvement comprising:

carrying out the sustaining discharge by alternatively performing following steps:

(1) when a low voltage level is applied onto said odd-numbered scanning electrodes and said even-numbered sustaining electrodes, a high voltage level is applied onto said even-numbered scanning electrodes and said odd-numbered sustaining electrodes, and (2) when a low voltage level is applied onto said even-numbered scanning electrodes and said odd-numbered sustaining electrodes, a high voltage level is applied onto said odd-numbered scanning electrodes and said even-numbered sustaining electrodes;

whereby during the sustain discharge period, the polarities of said odd-numbered scanning electrodes and said even-numbered sustaining electrodes are maintained identical, and the polarities of said even-numbered scanning electrodes and said odd-numbered sustaining electrodes are maintained identical.

2. An apparatus for driving a plasma display panel, each display lines of the plasma display comprising scanning electrodes and sustaining electrodes disposed in parallel with each other, the apparatus comprising:

a first driver, alternately applying a high and low voltage level to the sustaining electrodes of the odd-numbered display lines;

a second driver, alternately applying the high and low voltage level to the sustaining electrodes of the even-numbered display lines;

a third driver, alternately applying the high and low voltage level to the scanning electrodes of the odd display lines; and a fourth driver, alternately applying the high and low voltage level to the scanning electrodes of the even display lines;

wherein during a sustain discharge period of the plasma display panel, the high voltage level is applied to the scanning electrodes of the odd display lines and the sustaining electrodes of the even display lines when the low voltage level is applied to the sustaining electrodes of the odd display lines and the scanning electrodes of the even display lines, and the low voltage level is applied to the scanning electrodes of the odd display lines and the sustaining electrodes of the even display lines when the high voltage level is applied to the sustaining electrodes of the odd display lines and the scanning electrodes of the even display lines.

3. The apparatus as claimed in claim 2, wherein the first driver comprises:

a first circuit connected to all the sustaining electrodes of the odd display lines; and a first switch connected to the first circuit, switching between the high and low voltage level, by which the first circuit output the high or low voltage level accordingly.

4. The apparatus as claimed in claim 2, wherein the second driver comprises:

a second circuit connected to all the sustaining electrodes of the even display lines; and a second switch connected to the second circuit, switching between the high and low voltage level, by which the second circuit output the high or low voltage level accordingly.

5. The apparatus as claimed in claim 2, wherein the third driver comprises:

a third switch connected to all the scanning electrodes of the odd display lines, switching between the high and low voltage level.

6. The apparatus as claimed in claim 2, wherein the fourth driver comprises:

a fourth switch connected to all the scanning electrodes of the even display lines, switching between the high and low voltage level.

7. A plasma display panel comprising:

a plurality of scanning electrodes, said scanning electrodes being sequentially numbered as a plurality of odd-numbered scanning electrodes and even-numbered scanning electrodes;

a plurality of sustaining electrodes, said sustaining electrodes sequentially numbered as a plurality of odd-numbered sustaining electrodes and even-numbered sustaining electrodes, said scanning electrodes and said sustaining electrodes being interleaved disposed;

a first driver, selectively applying a first high and a first low voltage level to said odd-numbered scanning electrodes;

a second driver, selectively applying a second high and a second low voltage level to said even-numbered scanning electrodes;

a third driver, selectively applying a third high and a third low voltage level to said odd-numbered sustaining electrodes; and a fourth driver, selectively applying a fourth high and a fourth low voltage level to said even-numbered sustaining electrodes;

wherein during a sustain discharge period, (a) when said second low and said third low voltage levels are applied onto said even-numbered scanning electrodes and said odd-numbered sustaining electrodes, said first high and said fourth high voltage levels are applied onto said odd-numbered scanning electrodes and said even-numbered sustaining electrodes;

(b) when said first low and said fourth low voltage levels are applied onto said odd-numbered scanning electrodes and said even-numbered sustaining electrodes, said second high and said third high voltage levels are applied onto said even-numbered scanning electrodes and said odd-numbered sustaining electrodes;

whereby during the sustain discharge period, the polarities of said odd-numbered scanning electrodes and said even-numbered sustaining electrodes are maintained identical, and the polarities of said even-numbered scanning electrodes and said odd-numbered sustaining electrodes are maintained identical.

* * * * *

UNITED STATES PATENT AND TRADEMARK OFFICE

CERTIFICATE OF CORRECTION

PATENT NO. : 6,433,762 B1
DATED : August 13, 2002
INVENTOR(S) : Jih Fon Huang

It is certified that error appears in the above-identified patent and that said Letters Patent is hereby corrected as shown below:

Title page,
Item [30] should read:
-- (30) Foreign Application Priority Data
Nov. 5, 1998 (TW) ..... 87118452 --

Signed and Sealed this

Fourth Day of February, 2003

JAMES E. ROGAN
*Director of the United States Patent and Trademark Office*